US011786800B2

(12) United States Patent
Cox

(10) Patent No.: US 11,786,800 B2
(45) Date of Patent: Oct. 17, 2023

(54) ADJUSTABLE SKI SEAT ASSEMBLY

(71) Applicant: David J. Cox, Muskegon, MI (US)

(72) Inventor: David J. Cox, Muskegon, MI (US)

( * ) Notice: Subject to any disclaimer, the term of this patent is extended or adjusted under 35 U.S.C. 154(b) by 0 days.

(21) Appl. No.: 17/588,665

(22) Filed: Jan. 31, 2022

(65) Prior Publication Data

US 2022/0241674 A1 Aug. 4, 2022

Related U.S. Application Data

(60) Provisional application No. 63/144,081, filed on Feb. 1, 2021.

(51) Int. Cl.
*A63C 11/00* (2006.01)

(52) U.S. Cl.
CPC ..... *A63C 11/001* (2013.01); *A63C 2203/065* (2013.01)

(58) Field of Classification Search
CPC ..... A63C 11/001; A63C 2203/065; A63C 2203/10; A63C 5/033; A63B 6/00; A63B 59/00
See application file for complete search history.

(56) References Cited

U.S. PATENT DOCUMENTS

| | | | | |
|---|---|---|---|---|
| 1,116,487 A | | 11/1914 | Roche | |
| 2,257,831 A | | 10/1941 | Wood | |
| 2,963,299 A | | 12/1960 | Smith | |
| 3,003,778 A | | 10/1961 | Taggart | |
| 3,297,334 A | | 1/1967 | Jenks | |
| 3,314,687 A | | 4/1967 | Tiesler | |
| 3,778,077 A | | 12/1973 | Johnson | |
| 3,831,956 A | | 8/1974 | Earl | |
| 3,950,001 A | * | 4/1976 | Weigl | A63C 9/005 280/633 |
| 4,193,609 A | | 3/1980 | Bissett | |
| 4,324,409 A | * | 4/1982 | Larsen | A63C 11/002 280/14.1 |
| 4,722,539 A | | 2/1988 | Molinaro | |
| 4,865,572 A | | 9/1989 | Andes | |

(Continued)

FOREIGN PATENT DOCUMENTS

| | | | | |
|---|---|---|---|---|
| DE | 2408170 A1 | | 8/1975 | |
| DE | 20004998 U1 | * | 6/2000 | A63C 5/02 |

(Continued)

OTHER PUBLICATIONS

Crichton, Danny, "The 5-Year Bootstrapped Odyssey of Sno-Go, A Snow Bike for the Everyday Ski Mountain Visitor," https://techcrunch.com, Dec. 9, 2017, 4 pages.

(Continued)

*Primary Examiner* — James A Shriver, II
*Assistant Examiner* — Michael T. Walsh
(74) *Attorney, Agent, or Firm* — Price Heneveld LLP

(57) ABSTRACT

A ski seat assembly is provided that includes a support structure, a seat coupled to the support structure, and an adjustable binding insert mechanism coupled to the support structure. The adjustable binding insert mechanism including a toe piece, a heel piece, and an adjustable connector connecting the toe piece to the heel piece, wherein the adjustable connector is adjustable to adjust a length of the adjustable binding insert mechanism to fit into a binding on a ski.

13 Claims, 11 Drawing Sheets

(56) References Cited

U.S. PATENT DOCUMENTS

| | | | | |
|---|---|---|---|---|
| D325,765 | S | 4/1992 | Grantz et al. | |
| 5,324,058 | A * | 6/1994 | Massaro | B62J 1/06 280/220 |
| 5,441,184 | A | 8/1995 | Durso | |
| D389,210 | S | 1/1998 | Goodman | |
| 6,019,380 | A | 2/2000 | Goodman et al. | |
| 6,036,202 | A | 3/2000 | LaCome | |
| 6,969,074 | B2 * | 11/2005 | Piper | B62B 17/06 280/14.1 |
| 7,090,227 | B2 * | 8/2006 | Morin | B62B 13/12 280/22.1 |
| 7,444,769 | B2 | 11/2008 | Hall et al. | |
| 7,922,206 | B2 | 4/2011 | Kriezel | |
| 8,308,172 | B2 * | 11/2012 | Gulbranson | B62B 13/043 280/14.1 |
| 10,086,257 | B2 * | 10/2018 | Mehiel | A63C 10/145 |
| 2005/0001391 | A1 | 1/2005 | Piper | |
| 2006/0027982 | A1 | 2/2006 | Smith et al. | |
| 2009/0014995 | A1 | 1/2009 | Gulbranson | |
| 2011/0000057 | A1 * | 1/2011 | Abdul | A43C 11/146 24/68 E |

FOREIGN PATENT DOCUMENTS

| | | | | |
|---|---|---|---|---|
| DE | 202015000314 | U1 * | 4/2015 | A63C 11/001 |
| DE | 202015000314 | U1 | 4/2015 | |
| RU | 2712344 | C1 | 1/2020 | |

OTHER PUBLICATIONS

"The Original Source for SeatSkis & Polysleds," Speed Fever Sports Company, https://web.archive.org/web/19981212032943/http://speedfever.com, no date provided, 1 page.

Newbeck, Phyl, "Featured Athlete: The Jack Jumper Returns," Vermont Sports, www.vtsports.com, Mar. 12, 2019, 5 pages.

Wintersteiger Season 2020/2021 Accessories catalog, front page and p. 145.

"Modern Jackjumper with Shocks.jpg," https://commons.wikimedia.org/wiki/File:Modern_Jackjumpers_with_shocks.jpg, Oct. 29, 2020, 3 pages.

* cited by examiner

ADJUSTABLE SKI SEAT ASSEMBLY

CROSS-REFERENCE TO RELATED APPLICATION

This patent application claims priority under 35 U.S.C. § 119(e) to U.S. Provisional Patent Application No. 63/144,081, entitled "ADJUSTABLE SKI SEAT ASSEMBLY," filed on Feb. 1, 2021, the entire disclosure of which is incorporated herein by reference.

FIELD OF THE DISCLOSURE

The present disclosure generally relates to ski seat assemblies, and more particularly relates to a ski seat assembly that may be adjustable to accommodate fitting different size ski bindings.

BACKGROUND OF THE DISCLOSURE

Ski seat assemblies offer recreational activity for downhill skiing while seated on a platform or other seat. Typically, a ski seat assembly is fastened directly to an alpine ski, such as via threaded fasteners such as screws. As a result, the ski seat assembly generally remains fixed to the ski. It may be desirable to provide for a ski seat assembly that allows for a user to easily use the ski seat assembly on different skis having different size bindings.

SUMMARY OF THE DISCLOSURE

According to a first aspect of the present disclosure, an adjustable binding insert mechanism for connecting a ski seat to a ski, the adjustable binding insert mechanism includes a toe piece, a heel piece, and an adjustable connector connecting the toe piece to the heel piece, wherein the adjustable connector is adjustable to adjust a length of the adjustable binding insert mechanism to fit a binding on a ski.

Embodiments of the first aspect of the disclosure can include any one or a combination of the following features:

- the adjustable connector includes a first connector operatively coupled to the toe piece, a second connector operatively coupled to the heel piece, and a retainer for fixing the first connector to the second connector;
- the adjustable connector includes a rod operatively coupled to one of the toe piece and the heel piece, a collar operatively coupled to the other of the toe piece and the heel piece, and a clamp to hold the rod engaged in the collar;
- the adjustable connector includes a first plurality of teeth operatively coupled to one of the toe piece and the heel piece, one or more second teeth operatively coupled to the other of the toe piece and the heel piece, wherein the first plurality of teeth and the one or more second teeth are configured to engage one another to lock the toe and heel pieces in position at an adjusted length, and a locking member for locking the first plurality of teeth in position relative to the one or more second teeth;
- a spring for biasing the first plurality of teeth in engagement with the one or more second teeth, and a release mechanism for disengaging the first plurality of teeth from the one or more second teeth to adjust a length of the toe and heel assembly; and
- a locking lever for locking the first plurality of teeth into engagement with the one or more second teeth.

According to a second aspect of the present disclosure, a ski seat assembly is provided that includes a support structure, a seat coupled to the support structure and an adjustable binding insert mechanism coupled to the support structure. The adjustable binding insert mechanism including a toe piece, a heel piece, and an adjustable connector connecting the toe piece to the heel piece, wherein the adjustable connector is adjustable to adjust a length of the adjustable binding insert mechanism to fit into a binding on a ski.

Embodiments of the second aspect of the disclosure can include any one or a combination of the following features:

- the adjustable connector includes a first connector operatively coupled to the toe piece, a second connector operatively coupled to the heel piece, and a retainer for fixing the first connector to the second connector;
- the adjustable connector includes a rod operatively coupled to one of the toe piece and the heel piece, a collar operatively coupled to the other of the toe piece and the heel piece, and a clamp to hold the rod engaged in the collar;
- the adjustable connector includes a first plurality of teeth operatively coupled to one of the toe piece and the heel piece, one or more second teeth operatively coupled to the other of the toe piece and the heel piece, wherein the first plurality of teeth and the one or more second teeth are configured to engage one another to lock the toe and heel pieces in position at an adjusted length, and a locking member for locking the first plurality of teeth in position relative to the one or more second teeth;
- a spring for biasing the first plurality of teeth in engagement with the one or more second teeth, and a release mechanism for disengaging the first plurality of teeth from the one or more second teeth to adjust a length of the toe and heel assembly;
- a locking lever for locking the first plurality of teeth into engagement with the one or more second teeth;
- a seat post adjustably coupled to the support structure and a seat post clamp to adjust the position of the seat; and
- a spring operatively coupled to the seat post.

According to a third aspect of the present disclosure, a ski and seat assembly includes a ski, a binding mounted on the ski, and a ski seat assembly including a support structure, a seat coupled to the support structure, and an adjustable binding insert mechanism coupled to the support. The adjustable binding insert mechanism includes a toe piece, a heel piece, and an adjustable connector connecting the toe piece to the heel piece, wherein the adjustable connector is adjustable to adjust a length of the adjustable binding insert mechanism to fit into the binding on the ski.

Embodiments of the third aspect of the disclosure can include any one or a combination of the following features:

- the adjustable connector includes a first connector operatively coupled to the toe piece, a second connector operatively coupled to the heel piece, and a retainer for fixing the first connector to the second connector;
- the adjustable connector includes a rod operatively coupled to one of the toe piece and the heel piece, a collar operatively coupled to the other of the toe piece and the heel piece, and a clamp to hold the rod engaged in the collar;
- the adjustable connector includes a first plurality of teeth operatively coupled to one of the toe piece and the heel piece, one or more second teeth operatively coupled to the other of the toe piece and the heel piece, wherein the first plurality of teeth and the one or more second teeth are configured to engage one another to lock the toe and heel pieces in position at an adjusted length, and a locking member for locking the first plurality of teeth in position relative to the one or more second teeth;

the seat includes a seat post coupled to the support structure and a seat post clamp to adjust the position of the seat; and a spring operatively coupled to the seat post.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
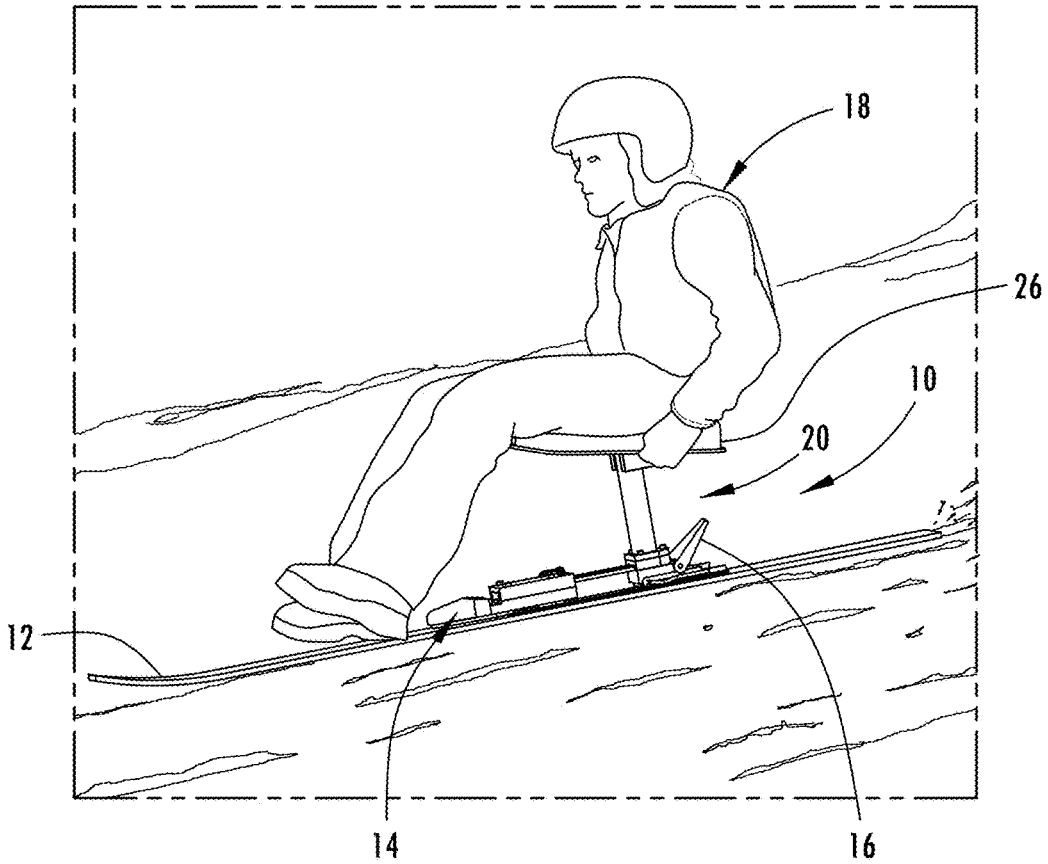
FIG. 1 is a schematic view of a ski and seat assembly illustrating a user seated on the seat, according to one example.

As required, detailed embodiments of the present disclosure are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

In the various figures, components which are equivalent with regard to their function are always given the same reference numerals so that they are generally also only described once.

Referring now to FIG. 1, a ski and seat assembly 10 is generally illustrated having a seated skier 18 shown seated while riding on the ski and seat assembly 10. The ski and seat assembly 10 includes a ski 12, such as an alpine or downhill snow ski intended to be used for downhill skiing on a slick terrain, such as snow found on a ski hill. The ski 12 has a binding 14 mounted to the top side thereof which is configured to receive a ski seat assembly 20 releasably connected to the binding 14 and extending above the top side of the ski 12. The binding 14 includes a heel lever 16 at the rear end of the binding 14 for locking the ski seat assembly 20 into an assembled connected positon and for releasing the ski seat assembly 20 from the binding 14 in a disassembled disconnected position.

Figure 2:
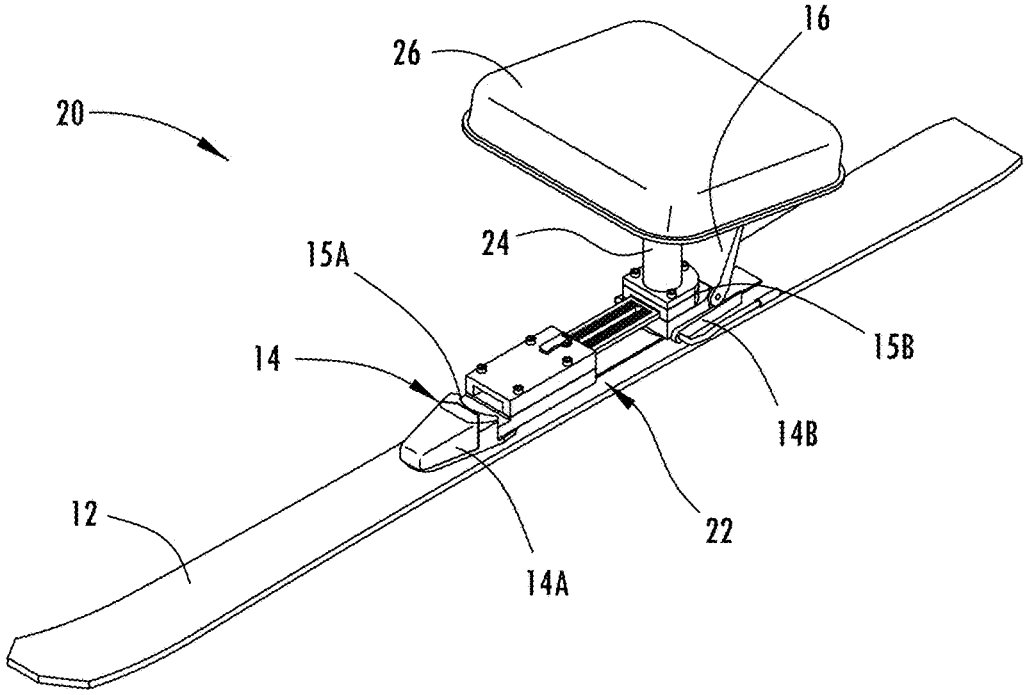
FIG. 2 is an enlarged perspective view of the ski and seat assembly shown in FIG. 1, according to a first embodiment.
Figure 3:
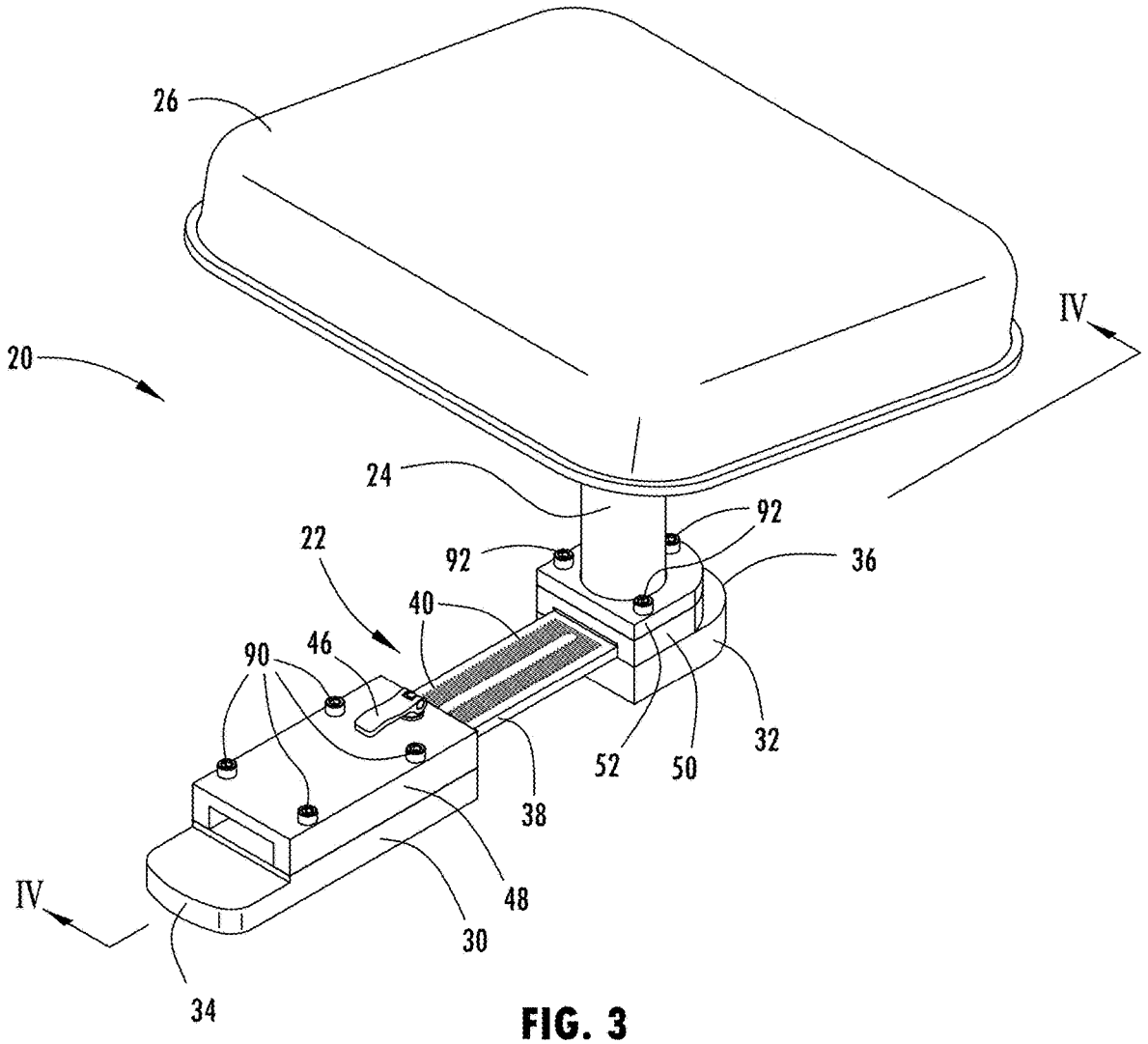
FIG. 3 is an enlarged perspective view of the ski seat assembly shown in FIG. 2 further illustrating the adjustable binding insert mechanism.
Figure 4:
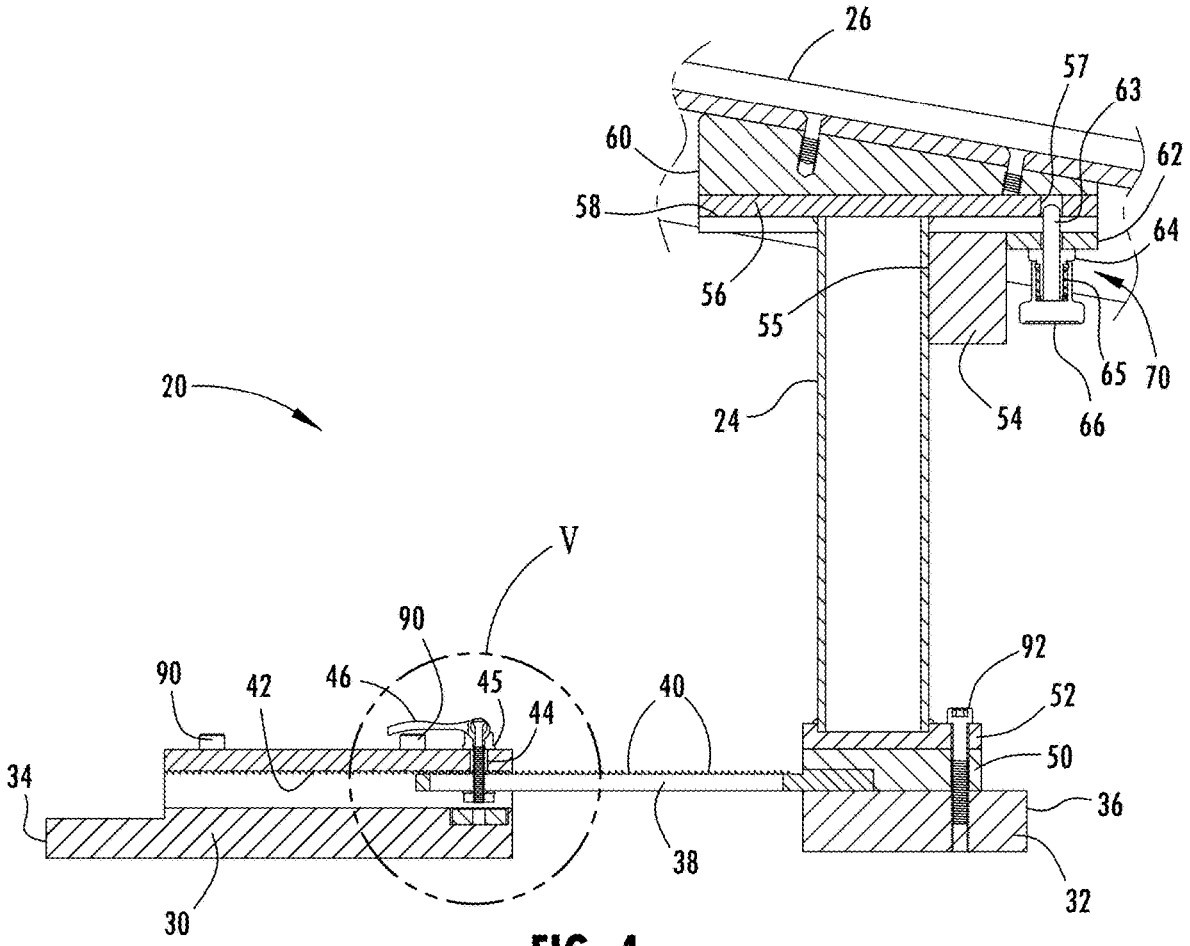
FIG. 4 is a cross-sectional side view of the ski seat assembly shown in FIG. 3 taken through line IV-IV of FIG. 3.
Figure 5:
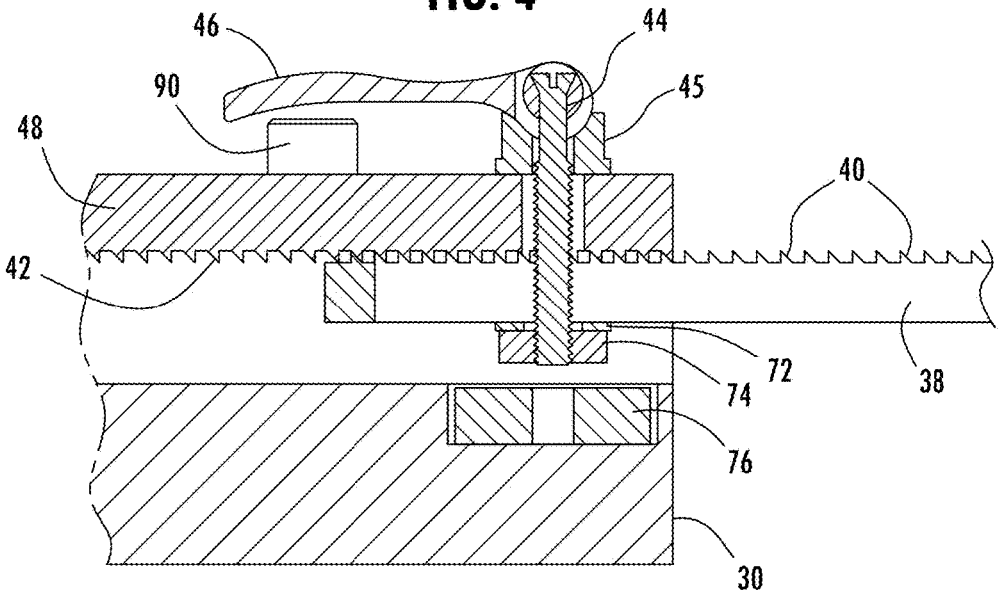
FIG. 5 is an enlarged view of section V taken from FIG. 4 further illustrating a locking mechanism for adjusting the length of the ski binding insert mechanism.
Figure 6:
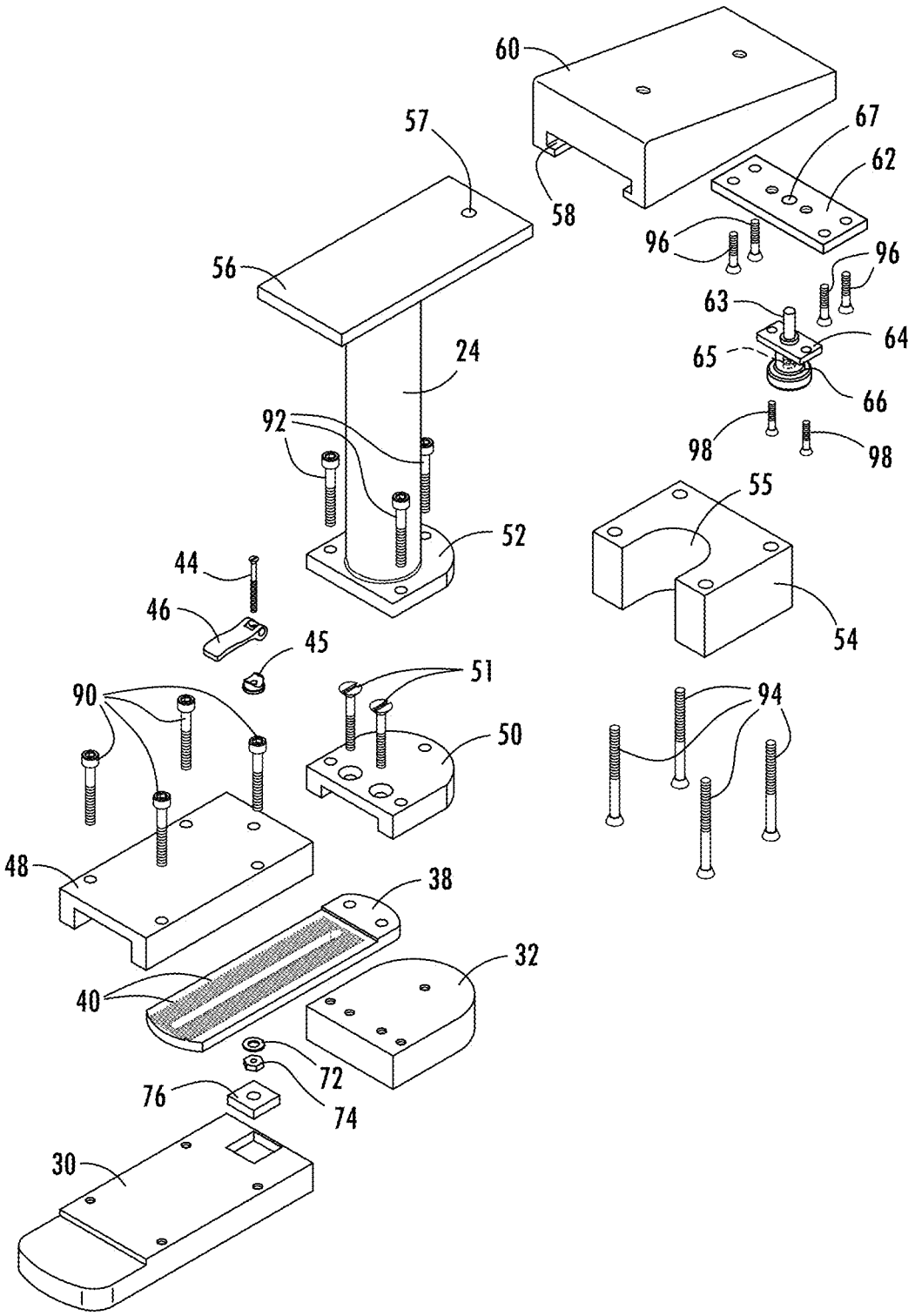
FIG. 6 is an exploded view of the ski seat assembly shown in FIG. 3 without the seat.

The ski and seat assembly 10 according to a first embodiment is further illustrated in FIG. 2 with the binding 14 having a toe piece 14A at the front of the binding 14 and a binding heel piece 14B at the rear end of the binding 14. The binding toe piece 14A has a toe cup 15A configured to receive a toe lug 34 on a ski boot or binding insert mechanism. The binding heel piece 14B has a heel cup 15B configured to receive a heel lug 36 on a ski boot or binding insert mechanism. The ski 12 and binding 14 may include a conventional alpine or downhill ski and binding assembly that may be configured to receive a ski boot of a skier. The binding 14 may be a fixed length binding that is assembled onto the ski 12 with a generally fixed distance length between the toe cup 15A of the toe binding piece 14A and the heel cup 15B of the binding heel piece 14B that accommodates a certain size ski boot for a standing skier or binding insert mechanism for the ski seat assembly 20 configured to seat a seated skier. The binding 14 is typically centered at or near a boot center mark on the ski for good ski performance.

The ski seat assembly 20 may advantageously be used on any of a number of skis and bindings which may have different size binding lengths. The ski binding assembly 20 has an adjustable binding insert mechanism 22 that may be adjusted in length to accommodate different size bindings on different skis. As such, a seated skier may easily transport and use the ski seat assembly 20 conveniently on many different skis without requiring the binding 14 to be remounted and/or adjusted in length.

The ski and seat assembly 10 includes the ski seat assembly 20 assembled onto the ski 12 via the binding 14. The ski seat assembly 20 is easily removable from the binding 14 by actuation of the heel lever 16. The ski seat assembly 20 includes the adjustable binding insert mechanism 22 coupled to the lower end of a support structure 24. The support structure 24 is shown configured having an upright or vertical member such as a cylindrical rod, and a seat mount plate configured to releasably connect to a seat, according to one example. However, it should be appreciated that the support structure 24 may include various shapes and sizes. For example, the support structure 24 may be configured with an arcuate shape that may flex to provide a suspension for the seated skier 18 to allow the seat 26 to flex and move up and down relative to the ski 12. The support structure may include one or more shock absorbing devices such as gas shocks or springs.

Mounted onto the upper end of the support structure 24 is the seat 26. The seat 26 may include a generally rectangular platform as the seat or a shaped seat that may conform generally to the shape of the seated skier 18. The seat 26 may include padding such as a cushion and/or may include a polymeric molded material. The seat 26 may be removably attached onto the upper end of the support structure 24 and may be adjusted in position relative to support structure 24.

The ski seat assembly 20 is further illustrated in FIGS. 3-6, according to the first embodiment. The toe piece 30 and heel piece 32 are connected together via an adjustable connector to form the adjustable binding insert mechanism 22. The toe piece 30 is shown having a front toe lug 34 having a contact surface for engaging the binding toe piece 14A. The front toe lug 34 is configured to fit within and conform to the shape of the binding toe piece 14A. The heel piece 32 has a rear heel lug 36 having a contact surface for engaging the binding heel piece 14B. The rear heel lug 36 has a shape configured to fit within and conform to the shape of the binding heel piece 14B. The toe piece 30 further includes an upper plate 48 fastened onto the lower plate 30 via threaded fasteners 90 such as screws. The bottom surface of the upper plate 48 includes a plurality of downward extending upper teeth 42 arranged generally in parallel rows extending downward generally transverse to the longitudinal axis of the adjustable binding insert mechanism 22.

The heel piece 32 has an upper plate 50 fastened thereon via threaded fasteners 92, such as screws. A middle plate 38 is thereby sandwiched and held between upper plate 50 and heel piece 32. The middle plate 38 has a plurality of upward extending lower teeth 40 arranged in parallel rows and formed on the top surface thereof that extend upward and transverse to the longitudinal axis of the adjustable binding insert mechanism 22. At least some of the plurality of upper teeth 42 on upper plate 48 are configured to matingly engage at least some of the plurality of lower teeth 40 on plate 38 so as to lock the toe piece 30 and heel piece 32 in a fixed length position.

A locking lever 46 is shown extending through plates 48, 38 and 30 via a threaded shaft 44 which engages washer 72 and nut 74 to fixedly clamp plates 48 and 38 together to lock the matingly engaged plurality of upper teeth 42 with the plurality of lower teeth 40 when positioned in a desired length position. Lever 46 has a cam surface 45 and may be pivoted upward and rotated about the threaded shaft 44 to loosen the connection to nut 74 and allow the plates 38 and 48 to be separated to allow for adjustment of the position of the toe piece 30 relative to the heel piece 32. Lever 46 may be tightened by screwing the threaded shaft 44 into nut 74 and pivoting downward the lever 46 on cam 45 to frictionally engage the plates 38 and 48 together to set a locking position of the plates 48 and 38.

The support structure 24 is shown connected at a lower end onto the heel piece 32 via connector 52 and threaded fasteners 92 such as screws. The top end of support member 24 includes seat mounting plate 56 which may slide within slot 58 of a seat mount 60. The support member 24 and mounting plate 56 may be integrally formed or otherwise connected together such as via welding, for example. Seat mount 60 may have a pin mounting plate 62 mounted on the underside via fasteners 96 such as screws. A spring biased pin connector 66 is fastened to the bottom side of the pin mounting plate 62 via fasteners 98, such as screws, to allow the mounting plate 56 to be fixed on the seat mount 60 and to be removed from the seat 26. In the assembled state, mounting plate 56 is fastened in position onto seat mount 60 to hold the seat 26 in position. Mounting plate 56 has a hole 57 configured to align with hole 67 to receive a locking pin 63 on the spring biased pin connector 66. Mounting plate 56 may include a plurality of holes spaced longitudinally to allow for forward and rearward adjustment of the seat 26. Spring biased pin connector 66 has a spring 65 biasing the pin 63 upwards towards and into connection with hole 67 in plate 62 and hole 57 in plate 56.

A support collar 54 having a cylindrical shaped surface 55 is fastened to the bottom side of the seat mount 60 via fasteners 94, such as screws. Collar 54 engages support structure 24 on surface 54 and serves as an end of travel limiter and structurally supports the engagement of the seat 26 onto the support structure 24.

Figure 7:
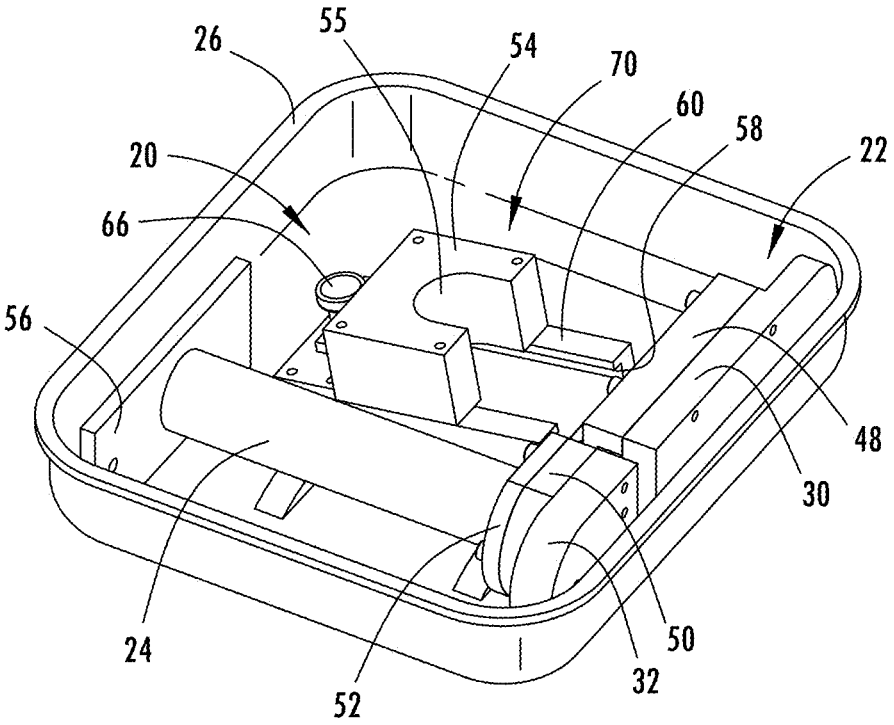
FIG. 7 is a perspective view of the ski seat assembly in a disassembled state and stored within the seat.
Figure 8:
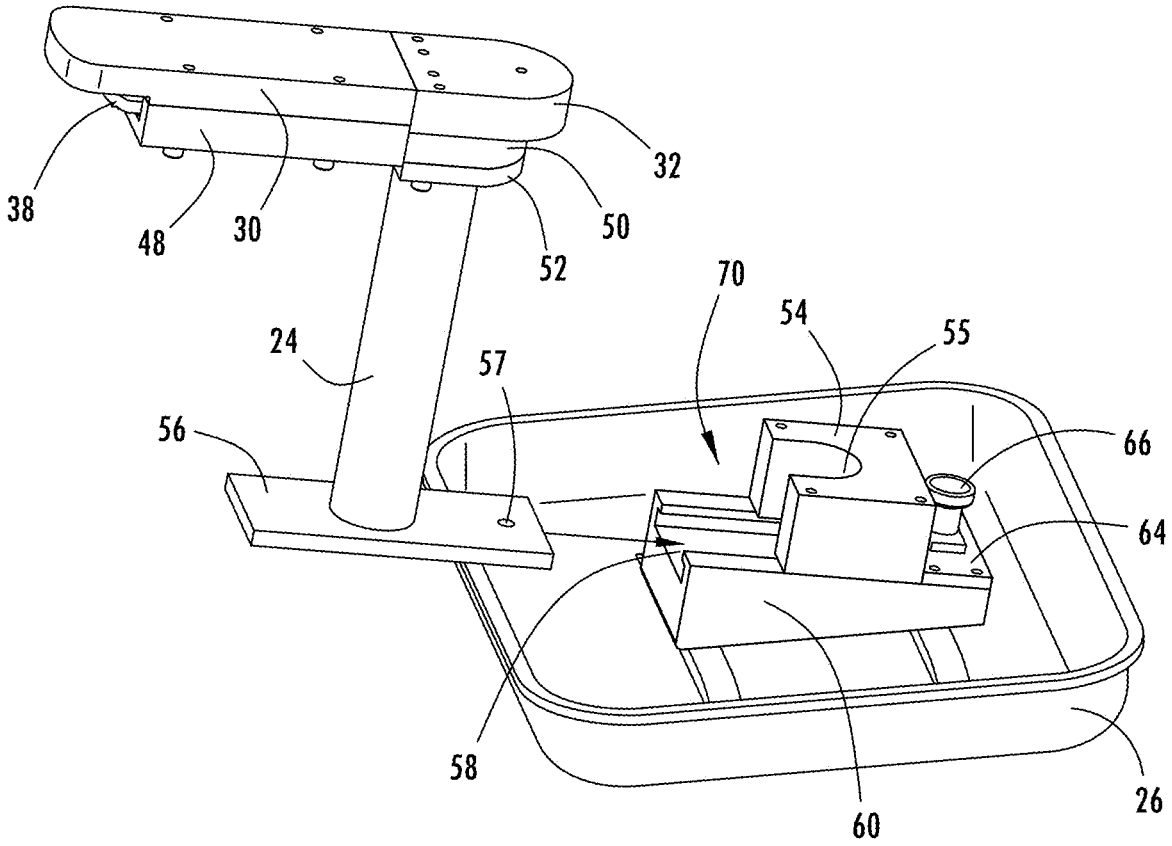
FIG. 8 is an assembly view of the ski seat assembly showing assembly of the ski seat onto the support structure of the ski seat assembly.
Figure 9:
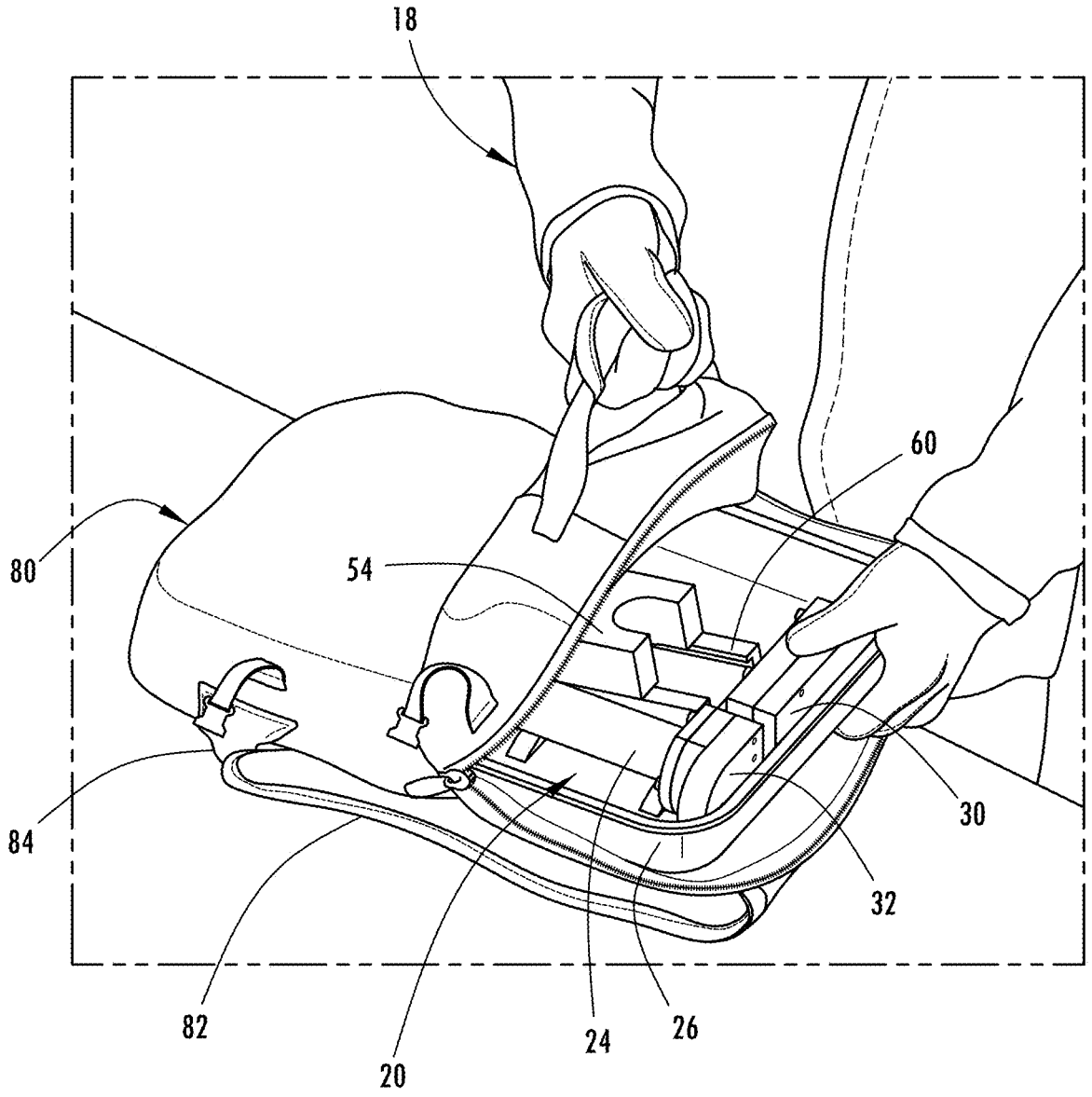
FIG. 9 is a perspective view of the disassembled seat assembly shown stowed within a backpack storage bag, according to one example.
Figure 10:
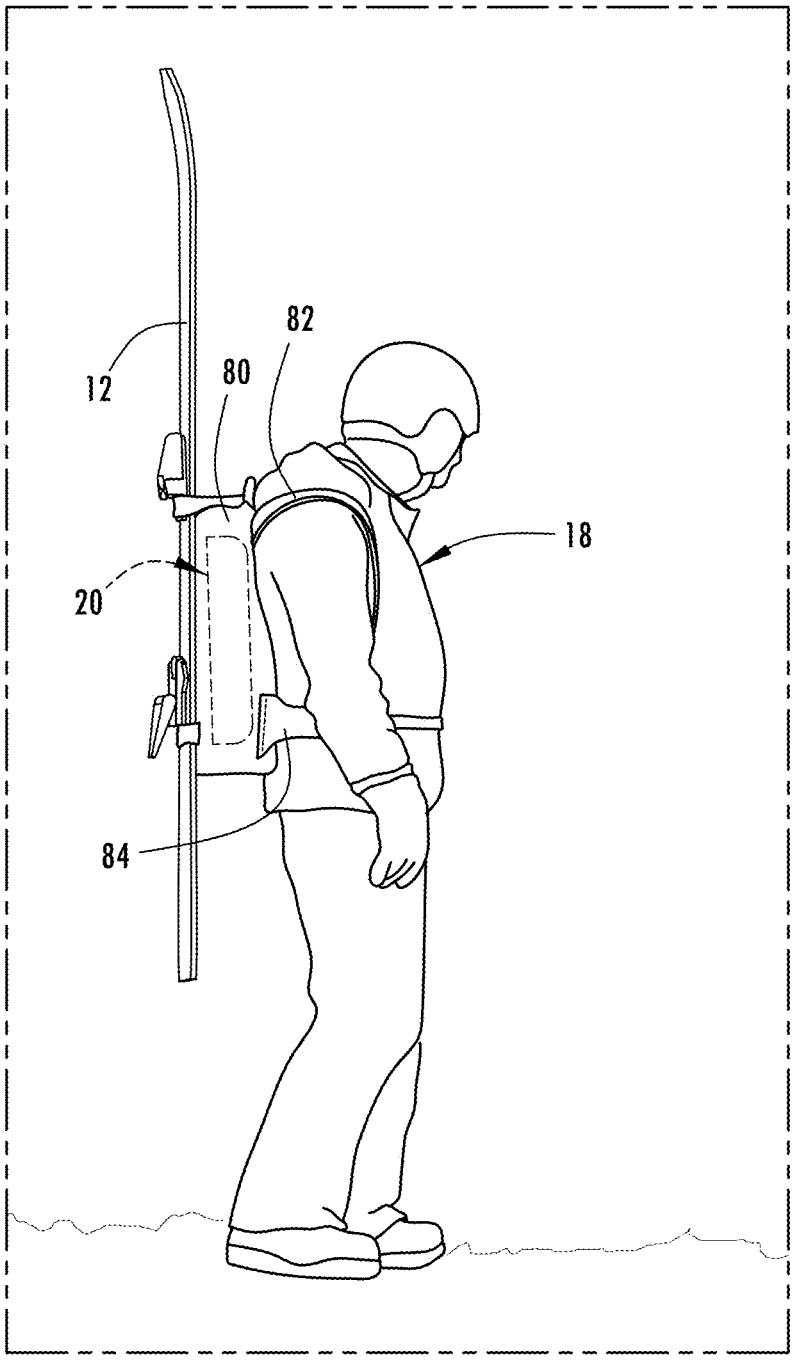
FIG. 10 is a perspective view of a user carrying the backpack storage bag with the ski seat assembly and ski, according to one example.

The ski seat assembly 20 may be assembled and disassembled as shown in FIGS. 7 and 8. To disassemble the ski seat assembly 20, the support member 56 is removed from the seat support 70 of seat 26 and the adjustable binding insert assembly 22 is removed from the ski binding 14. The ski seat assembly 20 in the disassembled state is compact in size such that it may be positioned within a compartment on the underside of the seat 26. The seat 26 and the other components of the ski seat assembly 20 may be inserted into a storage bag 80 such as a backpack as shown in FIG. 9. As shown in FIG. 10, the compactness of the ski seat assembly 20 may allow a user such as a skier to carry the backpack 80 on the skiers back with straps 82 and 84 along with the ski 12 for transportation to and from a ski area or other usage area.

Figure 11:
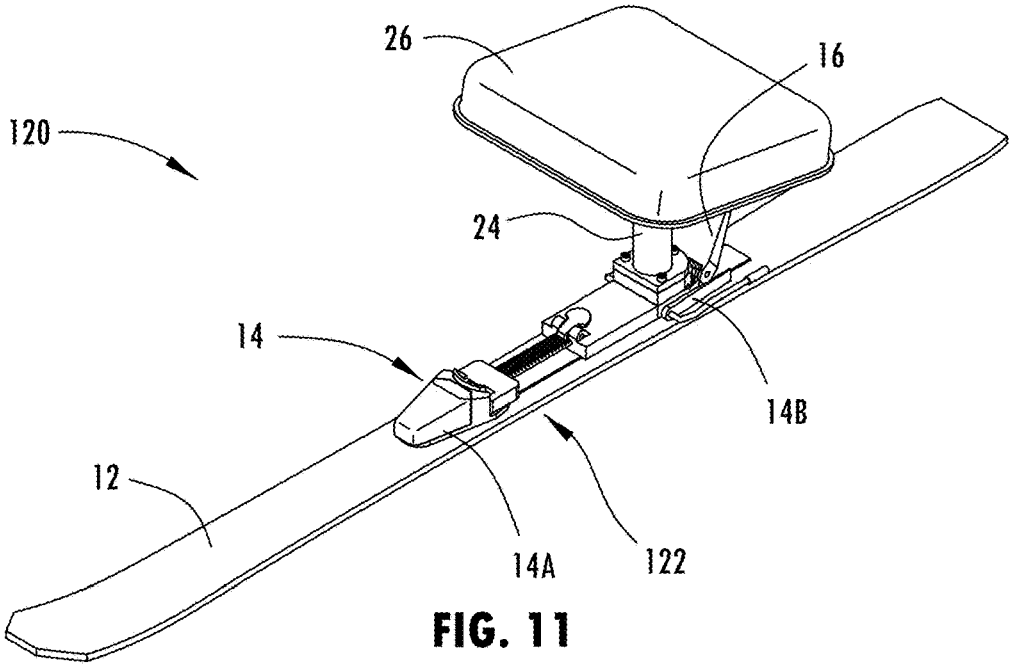
FIG. 11 is a perspective view of a ski and seat assembly having an adjustable binding insert mechanism, according to a second embodiment.
Figure 12:
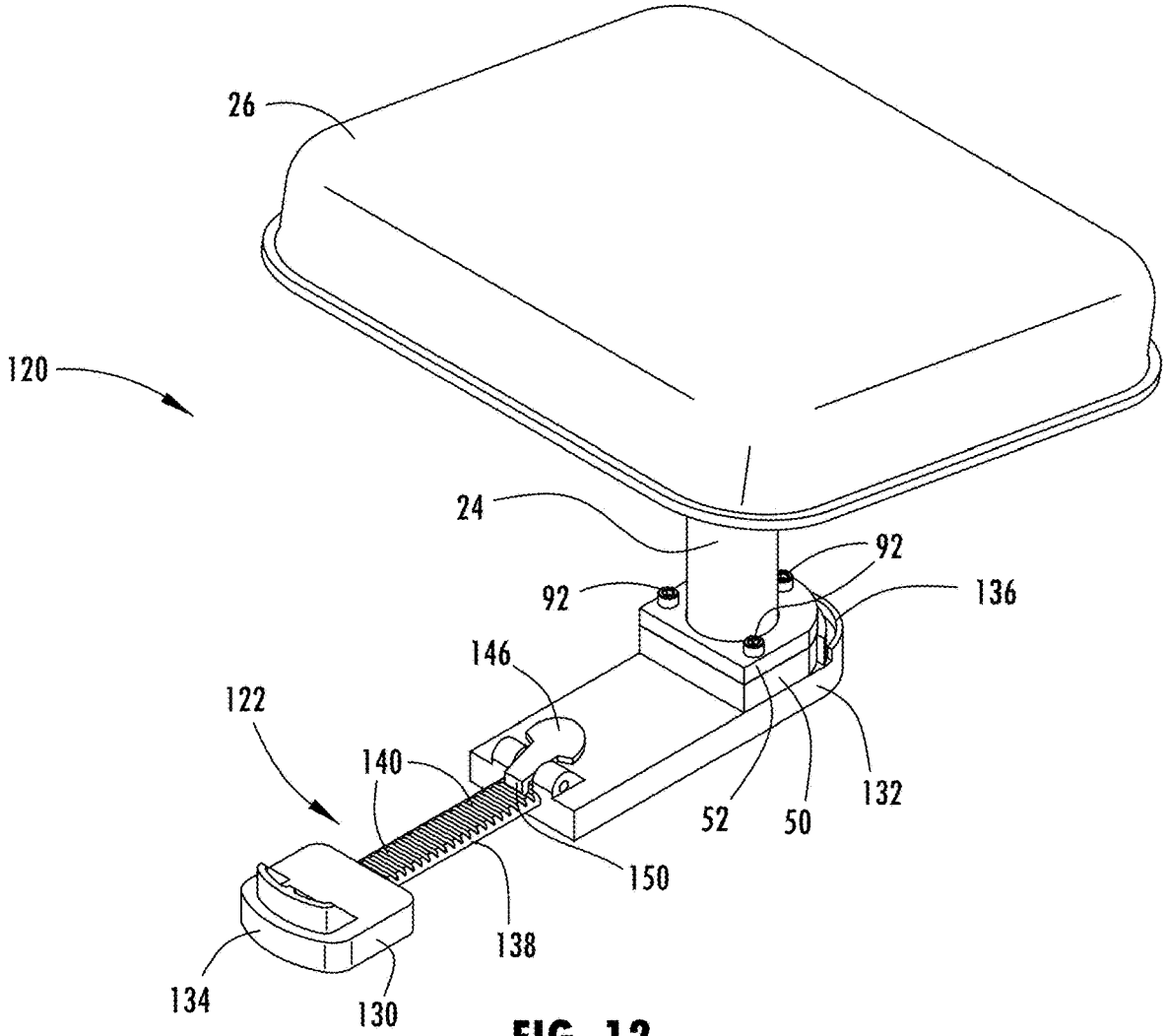
FIG. 12 is an enlarged perspective view of the ski seat assembly shown in FIG. 11 further illustrating the adjustable binding insert mechanism.

Referring to FIGS. 11 and 12, a ski seat assembly 120 is illustrated according to another embodiment. In this embodiment, the ski seat assembly 120 includes the support structure 24 and seat 26 and has an adjustable binding insert mechanism 122, according to another embodiment, which is configured to adjust in length to fit into the binding 14 on a ski 12. The adjustable binding insert mechanism 122 employs a single plate connected to the front toe piece 130 and having a plurality of rows of upward extending teeth 140 formed on the top surface thereof. A spring biased lever 146 having a downward extending tooth 150 is provided on the heel piece 132 on a top surface thereof. The spring biased tooth piece 146 has a single tooth that extends downward and is spring biased downward into engagement with one tooth of the plurality of teeth 140 on plate 138. When the spring biased lever 146 is forcibly rotated downward on one end and rotated so that the single tooth 150 is pivoted upward and is disengaged from the plurality of teeth 140, the toe plate 138 is free to slide within an opening of the heel piece 132 to adjust the distance length between the toe piece 130 and the heel piece 132. When in a desired position, the spring biased lever 146 may be released and spring biased downward such that the tooth 150 engages one of the teeth of the plurality of teeth 140 to lock the adjustable binding insert mechanism 122 into a fixed position at an adjusted length. As such, the length of the adjustable binding insert mechanism 122 may be easily changed simply by depressing and rotating spring biased lever 146 and sliding toe plate 138 relative to heel piece 132 to the desired distance length. It should be appreciated that the lever 146 with the single tooth 150 may be located on the toe piece 130 and the plurality of teeth 140 may be fixed to the heel piece 132, according to another example.

Figure 13:
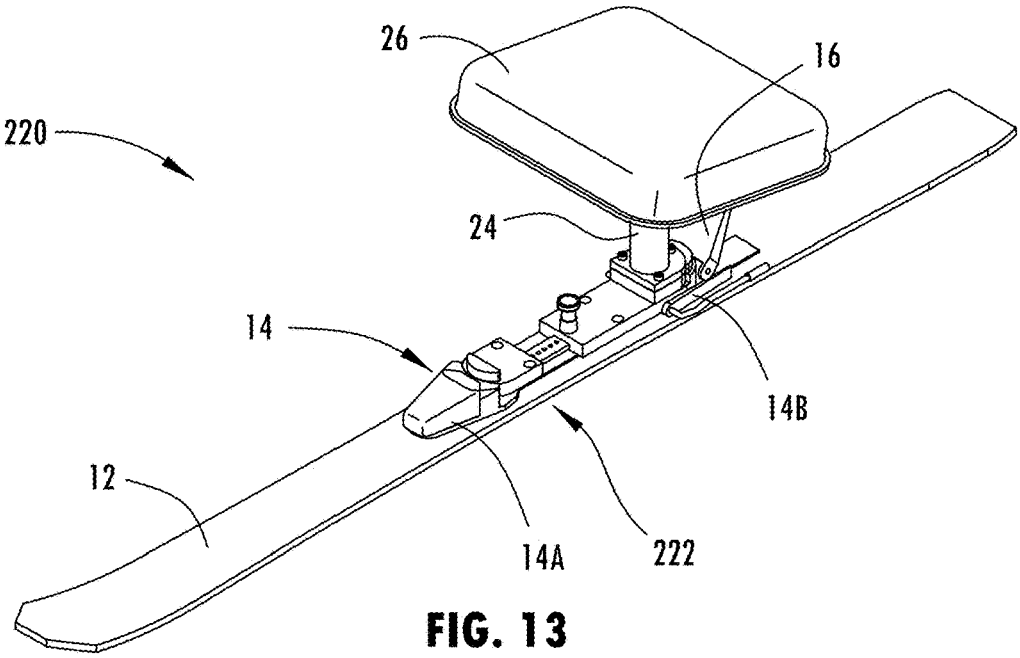
FIG. 13 is a perspective view of a ski and seat assembly having an adjustable binding insert mechanism, according to a third embodiment.
Figure 14:
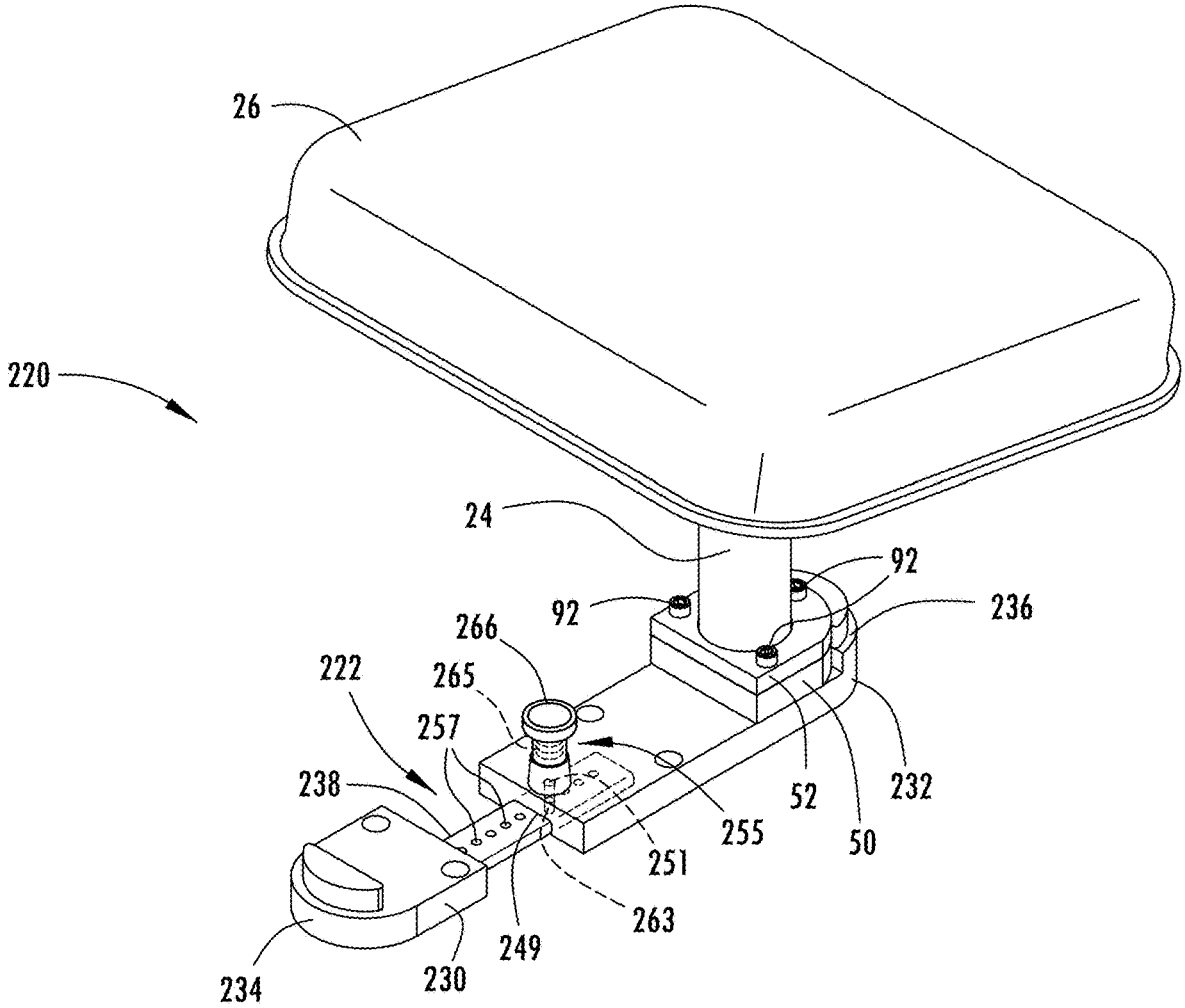
FIG. 14 is an enlarged perspective view of the ski seat assembly shown in FIG. 13 further illustrating the adjustable binding insert mechanism.

Referring to FIGS. 13 and 14, a ski seat assembly 220 is illustrated according to a further embodiment. In this embodiment, the ski seat assembly 220 includes the support structure 24 and seat 26 and has an adjustable binding insert mechanism 222, according to a further embodiment, which is configured to adjust in length to fit into the binding 14 on a ski 12. The adjustable binding insert mechanism 222 employs a single plate connected to the front toe piece 230 and has a rearward extending elongated plate 238 with holes 257 extending through the plate 238 and arranged serially in the longitudinal direction. Plate 238 may be a rod, for example. The adjustable binding insert mechanism 222 has a heel piece 232 supporting the support structure 24 on the top side thereof. Heel piece 232 has a slot 249 formed on the front side for receiving the elongated plate 238 of toe piece 230. The elongated plate 238 is able to slide within the slot 249 forward and rearward in order to adjust the length of the adjustable binding insert mechanism 222. The heel piece 232 further includes a locking mechanism 255 having a locking pin 263 extending through a hole 251 in the heel piece 232 for engaging a select one of the holes 257 in the plate 238. The locking mechanism 255 has a spring 265 that spring biases the locking pin 263 downward into a lock position within one of the holes 257 and a cap 266 allows a user to pull the locking pin 263 out of engagement with the holes 257 to adjust the length of the binding insert mechanism 222 and to release the cap 266 to allow the spring-biased locking pin to re-engage one of the holes 257 when the adjustable binding insert mechanism 222 is in the desired length position.

Figure 15:
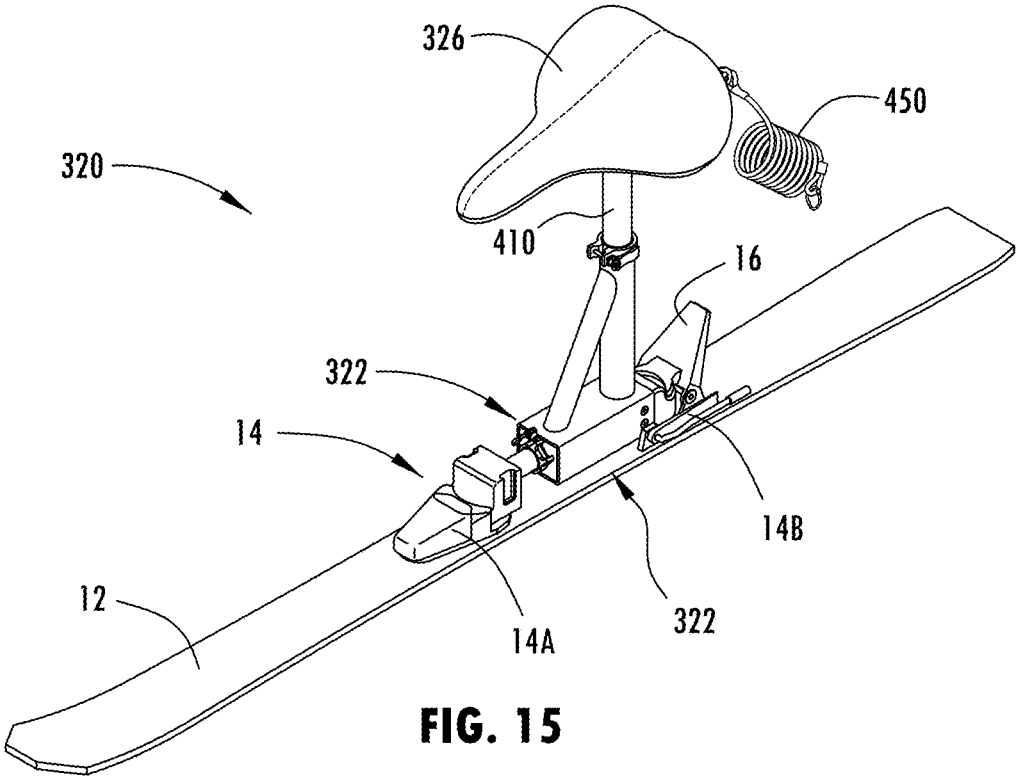
FIG. 15 is a perspective view of a ski and seat assembly having an adjustable binding insert mechanism, according to a fourth embodiment.
Figure 16:
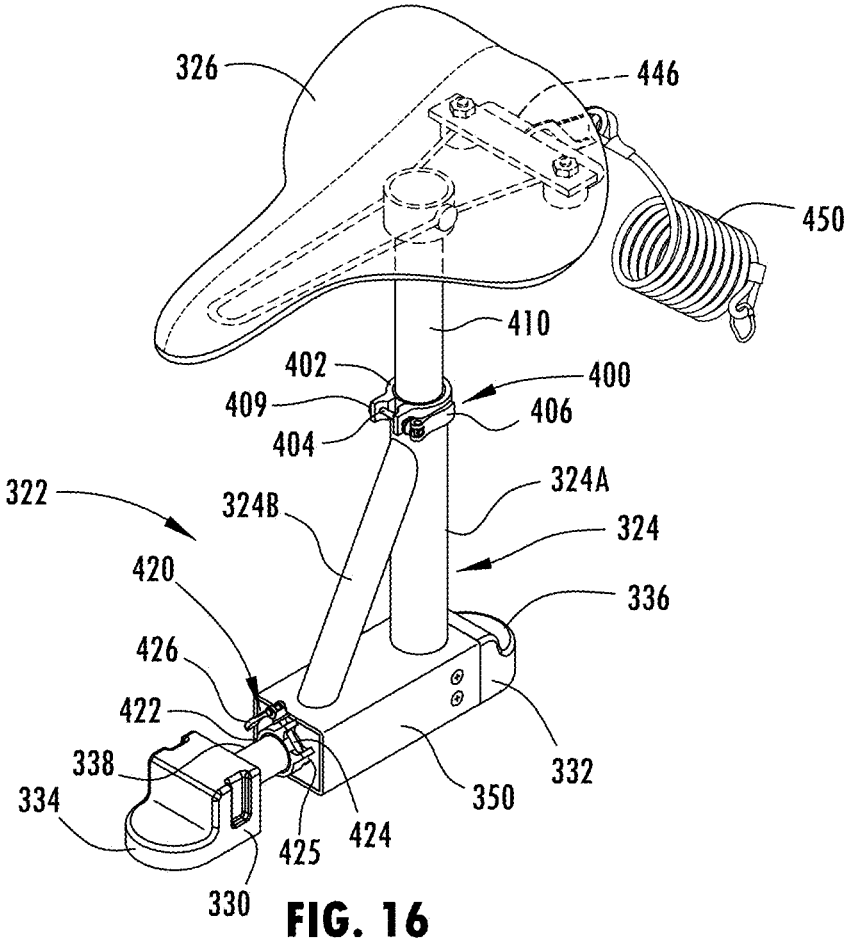
FIG. 16 is an enlarged perspective view of the ski seat assembly shown in FIG. 15 further illustrating the adjustable binding insert mechanism.
Figure 17:
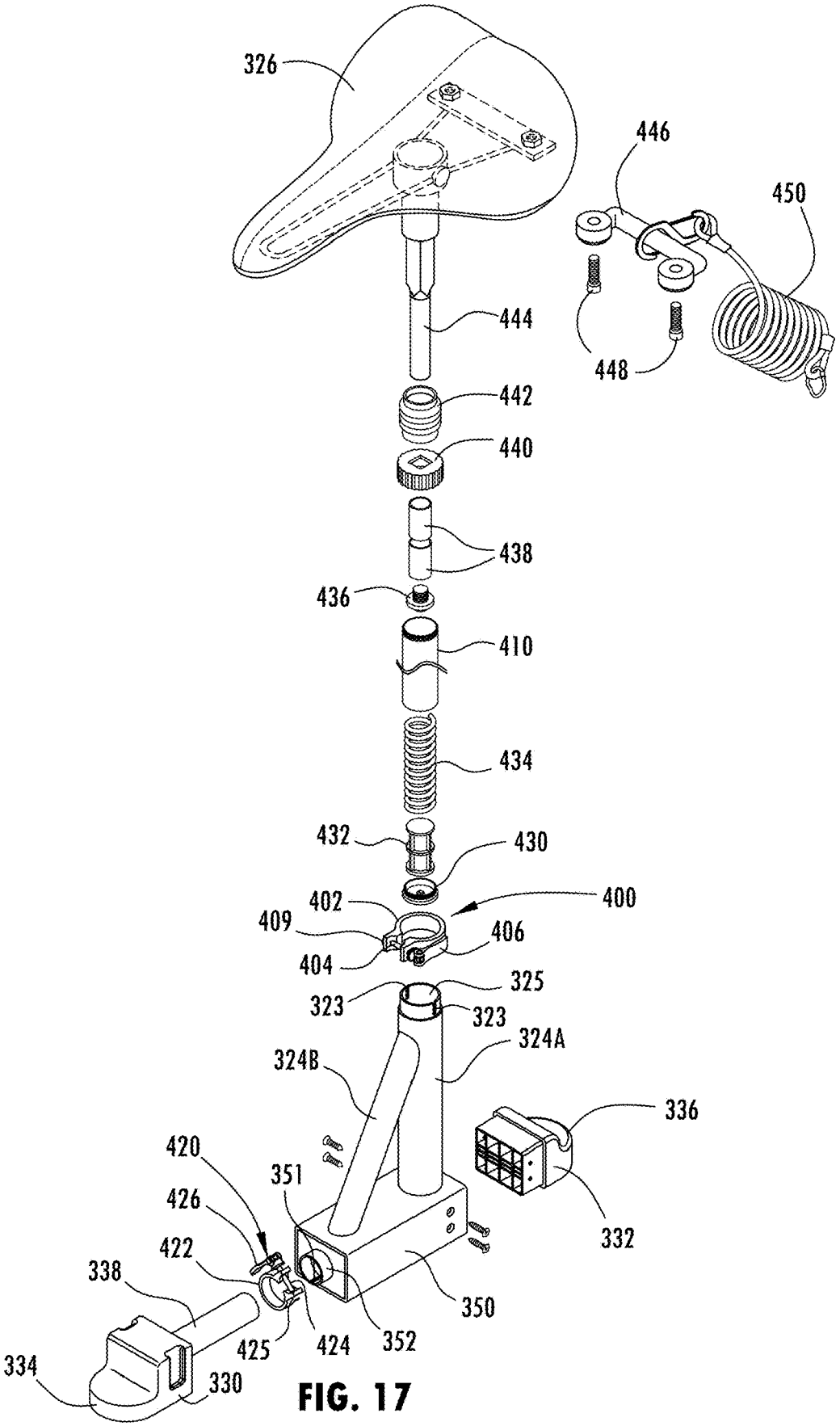
FIG. 17 is an exploded view of the ski seat assembly shown in FIG. 15 further illustrating the adjustable binding insert mechanism.

Referring to FIGS. 15-17, a ski seat assembly 320 for use on a ski 12 is illustrated according to yet a further embodiment. In this embodiment, the ski seat assembly 320 includes a seat 326 having a seat post 410 connected to an underlying support structure 324 which has an interconnected vertical support tube 324A and angled support tube 324B and an adjustable binding insert mechanism 322. The adjustable binding insert mechanism 322 is configured to adjust in length to fit into the binding 14 on the ski 12. The adjustable binding insert mechanism 322 employs a central mounting plate 350 connected to a front toe piece 330 which has a rearward extending elongated member shown in the form of a rod 338 such as a tube that serves as a first connector configured to matingly engage a collar 352 that serves as a second connector on mounting plate 350. A heel piece 332 is fastened to the rear end of the mounting plate 350. The front toe piece 330 has a front toe lug 334 adapted to engage the front toe piece of binding 14 and the rear heel piece 332 has a rear heel lug 336 configured to engage the rear heel piece 14B of binding 14.

The adjustable binding insert mechanism 322 may be adjusted in length by sliding to adjust the position of rod 338 within collar 352 on the mounting plate 350. Rod 338 may be a cylindrical tube having a tubular or cylindrical shape with a diameter slightly smaller than the internal tubular surface diameter of collar 352. Collar 352 includes one or more slits 351 which allow the collar 352 to compress and reduce in size when forcibly squeezed radially inward on the outer surface to reduce its diameter and frictionally engage rod 338 in a fixed position. An adjustable post clamp 420 extends over collar 352 to compress collar 352 onto the outer surface of rod 338 to clamp rod 338 in a fixed position. Accordingly, the user may adjust the length of the rod 338 within collar 352 to adjust the length of the adjustable binding insert mechanism 322.

The adjustable post clamp 420 may be a quick release post binder bolt, according to one example. The adjustable post clamp 420 has a cylindrical collar portion 422 that may be sized and configured to fit over collar 352. A threaded bolt 424 extends across opposite ends of collar 420 to extend or shorten the distance between the ends to make the collar portion 422 larger or smaller in diameter. The post clamp 420 further includes a lever 426 at one end of bolt 424 and a nut 425 at the opposite end of bolt 424 which allows the effective length of the bolt 404 engaging the ends of the collar portion 422 to be adjusted. The lever 426 may pivot on a cam surface to a locked position to lock the post clamp 420 in a fixed position on collar 352.

The ski seat assembly 320 is shown in this embodiment having a seat 326 which may be configured the same or similar to a bicycle seat, according to one example. A seat post 410 extends from the seat 326 downward and engages the vertical support tube 324A which has an angled cross tube 324B. Both the vertical support tube 324A and angled cross support tube 324B are connected to mounting plate 350. The seat post 410 extends downward into a cylindrical opening in a collar 325 of the vertical support tube 324A and the height of the seat post 410 and seat 326 may be adjusted by releasing and retightening the adjustable seat post clamp 400. The adjustable seat post clamp 400 may be a quick release post binder bolt, according to one example. The seat post clamp 400 has a collar portion 402 adapted to engage the collar 325 on the top of vertical support tube 324A. In addition, an adjustable bolt 404 extends across ends of a collar portion 402 and is controlled by a lever 406 at one end and a nut 409 at the opposite end is provided to adjust the effective length of the bolt 404 engaging the ends of the collar portion 402 to tighten the position of the seat post 410 within the collar 325 on the vertical support tube 324A.

The seat post 410 is further illustrated having various components housed therein including a coil spring 434. Spring 434 provides for a suspension built into the seat post 410 to allow the seat 326 under force to move down and return to the upright position when the force is removed. The spring 434 is housed in seat post 410 with bottom plug 432 disposed therein and in contact with the spring 434. An adjustable bottom nut 430 is threadingly engaged to the lower end of the seat post 410 to contain the contents within the seat post. Nut 430 is threaded on the outer surface to engage threading on the inner surface of seat post 410 and may be rotated to move in and out of the seat post 410 to move up and down to compress or relax the spring 434. The adjustable nut 430 may allow for adjustment of the spring 434 to tighten or loosen the spring force and adjust the travel length of the spring 434 to thereby adjust the suspension. An upper fitting 436 and plug 438 are located above the spring 434 to engage the spring 434 on the top side. A cap 440 threadingly engages the top end of seat post 410. A flexible rubber sleeve 442 extends over the cap 440 to prevent or reduce dirt, snow and water from entering the seat post 410.

The seat 326 has a handle 446 located on the rear underside. The handle 446 is configured to allow a user to engage and transport the ski seat assembly 320. Handle 446 is connected to seat 326 via fasteners 448.

The ski seat assembly 320 may further include a strap 450 or other retainer connected at one end to the handle 446 or elsewhere on the ski seat assembly and configured to connect at the opposite end to a user or apparel of the user via a connector such as a carabiner, for example, to prevent the ski seat assembly 326 from traveling away from the user. It should be appreciated that other retainers such as ski brakes may be employed.

The ski seat assembly 20, 120, 220 and 320 may be made of various materials. For example, the support structure and the adjustable binding insert mechanism may be made of a metal, such as aluminum. In another example, the support structure and the adjustable binding insert mechanism may be made of a polymeric material and may be fabricated using injection molding, 3D printing and/or machining.

Accordingly, the ski seat assembly 20, 120, 220 and 320 advantageously provides for a compact and easy to use ski seat that may be installed onto a wide variety of skis having bindings configured for different lengths without having to remount or otherwise adjust the binding size length on the skis. This allows for seated ski users to easily transport the ski seat assembly from one location to another and use the assembly on any of a number of skis with different size bindings.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. An adjustable binding insert mechanism for connecting a ski seat to a ski, the adjustable binding insert mechanism comprising:
- a toe piece;
- a heel piece; and
- an adjustable connector connecting the toe piece to the heel piece, wherein the adjustable connector is adjustable to adjust a length of the adjustable binding insert mechanism to fit a binding on a ski, wherein the adjustable connector comprises:
  - a rod operatively coupled to one of the toe piece and the heel piece;
  - a collar operatively coupled to the other of the toe piece and the heel piece; and
  - a clamp to hold the rod engaged in the collar.

2. The adjustable binding insert mechanism of claim 1, wherein the clamp comprises an adjustable post clamp.

3. The adjustable binding insert mechanism of claim 2, wherein the adjustable post clamp comprises a cylindrical collar portion configured to fit over the collar.

4. A ski seat assembly comprising:
- a support structure;
- a seat coupled to the support structure; and
- an adjustable binding insert mechanism coupled to the support structure, the adjustable binding insert mechanism comprising:
  - a toe piece;
  - a heel piece; and
  - an adjustable connector connecting the toe piece to the heel piece, wherein the adjustable connector is adjustable to adjust a length of the adjustable binding insert mechanism to fit into a binding on a ski, wherein the adjustable connector comprises:
  - a rod operatively coupled to one of the toe piece and the heel piece;
  - a collar operatively coupled to the other of the toe piece and the heel piece; and
  - a clamp to hold the rod engaged in the collar.

5. The ski seat assembly of claim 4, wherein the seat comprises a seat post adjustably coupled to the support structure and a seat post clamp to adjust the position of the seat.

6. The ski seat assembly of claim 5 further comprising a spring operatively coupled to the seat post.

7. The ski and seat assembly of claim 4, wherein the clamp comprises an adjustable post clamp.

8. The ski and seat assembly of claim 7, wherein the adjustable post clamp comprises a cylindrical collar portion configured to fit over the collar.

9. A ski and seat assembly comprising:
- a ski;
- a binding mounted on the ski;
- a ski seat assembly comprising:
  - a support structure;
  - a seat coupled to the support structure; and
  - an adjustable binding insert mechanism coupled to the support, the adjustable binding insert mechanism comprising:
    - a toe piece;
    - a heel piece; and
    - an adjustable connector connecting the toe piece to the heel piece, wherein the adjustable connector is adjustable to adjust a length of the adjustable binding insert mechanism to fit into the binding on the ski, wherein the adjustable connector comprises:
  - a rod operatively coupled to one of the toe piece and the heel piece;
  - a collar operatively coupled to the other of the toe piece and the heel piece; and
  - a clamp to hold the rod engaged in the collar.

10. The ski and seat assembly of claim 9, wherein the seat comprises a seat post coupled to the support structure and a seat post clamp to adjust the position of the seat.

11. The ski and seat assembly of claim 10, wherein the seat further comprises a spring operatively coupled to the seat post.

12. The ski and seat assembly of claim 9, wherein the clamp comprises an adjustable post clamp.

13. The ski and seat assembly of claim 12, wherein the adjustable post clamp comprises a cylindrical collar portion configured to fit over the collar.

* * * * *